US006948912B2

(12) United States Patent
Chang et al.

(10) Patent No.: US 6,948,912 B2
(45) Date of Patent: Sep. 27, 2005

(54) HEAT DISSIPATION DEVICE AND ITS IMPELLER THEREOF

(75) Inventors: Shun-Chen Chang, Ying Ko Town (TW); Kuo-Cheng Lin, Tao Yuan (TW); Wen-Shi Huang, Jung Li (TW); Po-Hao Yu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 10/417,272

(22) Filed: Apr. 17, 2003

(65) Prior Publication Data

US 2004/0096326 A1 May 20, 2004

(30) Foreign Application Priority Data

Nov. 18, 2002 (TW) ..... 91218524 U

(51) Int. Cl.[7] ..... F04D 29/38
(52) U.S. Cl. ..... 416/185; 416/234
(58) Field of Search ..... 416/185, 198 R, 416/228, 234; 415/199.5; 361/695

(56) References Cited

U.S. PATENT DOCUMENTS

| | | | | | |
|---|---|---|---|---|---|
| 3,289,920 | A | | 12/1966 | Bolvie | 415/208.2 |
| 4,152,099 | A | * | 5/1979 | Bingler | 417/420 |
| 4,895,489 | A | | 1/1990 | Kohama et al. | 415/218.1 |
| 4,904,159 | A | | 2/1990 | Wickoren | 416/183 |
| 5,217,351 | A | * | 6/1993 | Meier et al. | 415/219.1 |
| 5,588,178 | A | | 12/1996 | Liu | 15/330 |
| 5,791,568 | A | | 8/1998 | Keim | 241/47 |
| 6,065,936 | A | * | 5/2000 | Shingai et al. | 416/175 |
| 6,244,818 | B1 | * | 6/2001 | Chang | 415/208.2 |
| 6,270,313 | B1 | | 8/2001 | Chuang et al. | 415/148 |
| 6,394,754 | B1 | | 5/2002 | Choi | 416/238 |
| 6,659,724 | B2 | * | 12/2003 | Takeuchi et al. | 416/185 |

FOREIGN PATENT DOCUMENTS

| | | |
|---|---|---|
| CH | 638 593 | 9/1983 |
| CN | 2374677 | 4/2000 |
| CN | 2476669 | 2/2002 |
| DE | 100 20 878 | 5/2002 |
| JP | 7-279883 | 10/1995 |
| TW | 296779 | 8/1985 |
| TW | 395527 | 7/1987 |
| TW | 488497 | 5/2002 |
| WO | 01/38697 | 5/2001 |

* cited by examiner

*Primary Examiner*—Edward K. Look
*Assistant Examiner*—Dwayne J. White

(57) ABSTRACT

A heat dissipation device and a blade structure thereof are employed to increase input air volume, A new impeller, mounted on the driving means, includes a hub and a plurality of rotor blades arranged around the hub. Preferably, the inner side of each rotor blades extends to a top surface and side surface of the hub. An upper edge of the rotor blades can extend axially beyond the top surface of the hub in the air inlet end for increasing the intake airflow by introducing the side airflow through the space defined between the inner edges of the plurality of rotor blades and the top surface of the hub.

27 Claims, 7 Drawing Sheets

Top view

Side view 1

Side view 2

Perspective View

HEAT DISSIPATION DEVICE AND ITS IMPELLER THEREOF

BACKGROUND OF THE INVENTION

1. Field of Invention

The present invention relates to a heat dissipation device and an impeller thereof. More particularly, the present invention relates to an axial-flow fan and a blade structure thereof.

2. Description of Related Art

There are several types of heat dissipation device on the market, including fans and blowers, and fans are commonly used in personal computers. Fans are suitable for a system with low impedance. That is, the static pressure of fans is lower.

FIGS. 1A and 1B illustrate a conventional fan having a frame 10 and an impeller 11. The impeller 11 includes a hub 111 and a plurality of blades 112 arranged around the hub. When airflow is generated by the impeller motivated by a driving means (such as motor) and passes through the hub 111 and blades 112 of the fan, air turbulence 12 (as illustrated in FIG. 1B) may occur when the airflow encounters the top surface of the hub so that the volume and the blast pressure of airflow discharged from the fan will be greatly reduced. Thus, it is desired to develop a fan which can improve a fan which can improve the above-described problems.

SUMMARY OF THE INVENTION

It is therefore an objective of the present invention to provide a heat dissipation device and a blade structure thereof for increasing input air volume, because heat dissipation efficiency of the heat dissipation device depends not only on static pressure, but also on input air volume. In accordance with the objective of the present invention, a new impeller mounted on the driving means includes a hub and a plurality of rotor blades connected to the hub radially. Preferably, the inner side of each rotor blade extends to a top surface and side surface of the hub. An edge of the rotor blades can extend axially beyond the top surface of the hub in the air inlet end.

It is another an objective of the present invention to apply this impeller to a heat dissipation device with air-guiding and rotor blades. More than one impeller is also applied to a heat dissipation device with multiple air-guiding blades; for example, impellers having a plurality of rotor blades extending axially beyond the top surface of the hub are respectively placed on both sides of the air-guiding blade disposed in one or more frames.

Thus, this impeller with a plurality of rotor blades having upper edge higher than the top surface of the hub can increase input air volume by introducing side-airflow. Further, the heat dissipation device with air-guiding and rotor blades can significantly increases input air volume and the blast pressure.

It is to be understood that both the foregoing general description and the following detailed description are examples only, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1A:
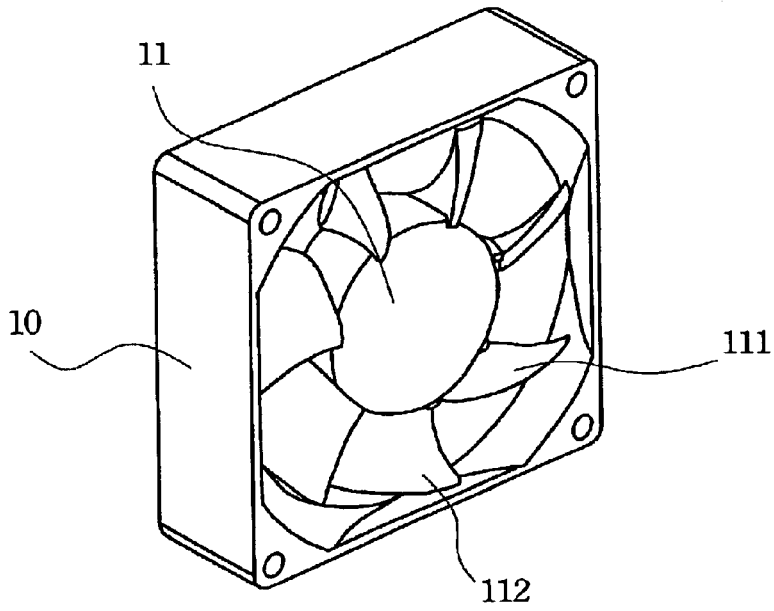
Fig. 1A (PRIOR ART)
FIGS. 1A and 1B illustrate a conventional fan.

Reference will now be made in detail to the present preferred embodiments of the invention, examples of which are illustrated in the accompanying drawings. Wherever possible, the same reference numbers are used in the drawings and the description to refer to the same or like parts.

Figure 1B:
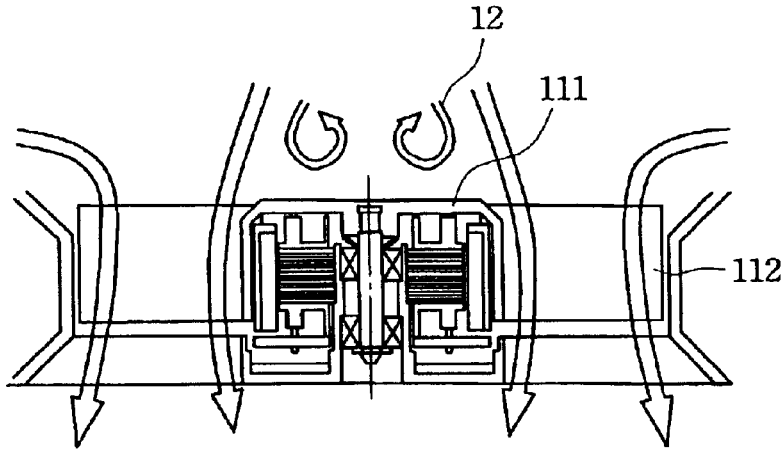
Fig. 1B (PRIOR ART)
Figure 2A:
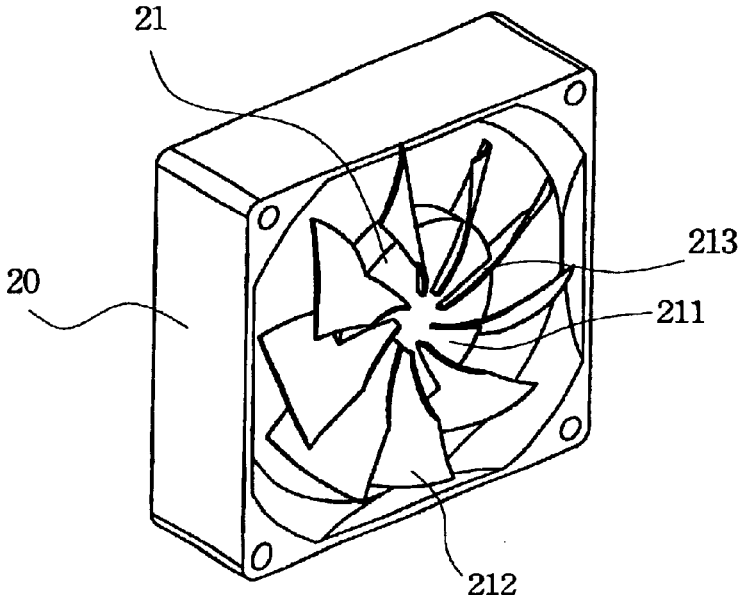
FIG. 2A illustrates a perspective view of a heat dissipation device according to one preferred embodiment of this invention.
Figure 2B:
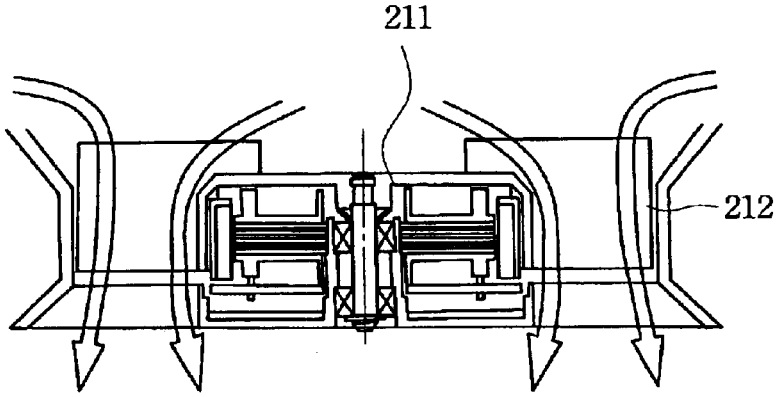
FIG. 2B illustrates a cross-sectional view of FIG. 2A.
Figure 3A:
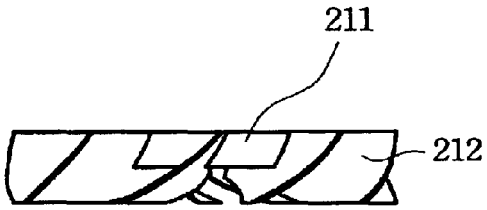
FIGS. 3A–3D respectively illustrate a top view, front view, side view and perspective view of the impeller of the heat dissipation device according to one preferred embodiment of this invention.
Figure 3B:
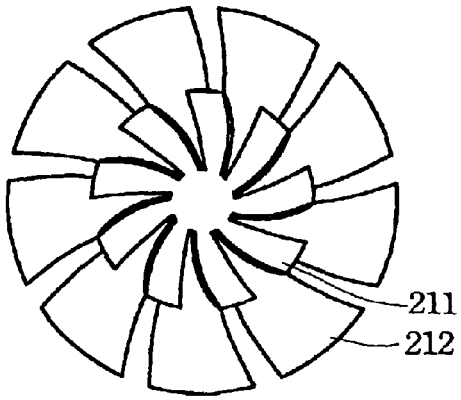
Figure 3C:
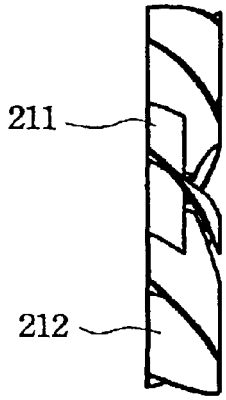
Figure 3D:
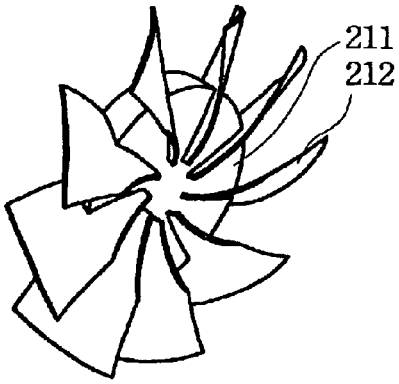

FIG. 2A illustrates a heat dissipation device according to one preferred embodiment of this invention and FIG. 2B illustrates a cross-sectional view of FIG. 2A. The heat dissipation device includes a frame 20 and an impeller 21 disposed in the inlet side of the frame. The impeller 21 includes a hub 211 and a plurality of rotor blades 212 arranged around the hub 211. In order to increase the input air volume, the upper edge of the rotor blades 213 extends axially beyond the top surface of the hub 211 or further extends to the top surface of the hub 10. In other word, the rotor blade 212 not only connects to a side surface of the hub 211 but also reaches the top surface of the hub 211. It is noted that this new design advantageously increases the input air volume by introducing side-airflow. Therefore, air turbulence 12 as shown in FIG. 1B will be eliminated when airflow passes through hub 211 and rotor blades 212 of the heat dissipation device.

Figure 4A:
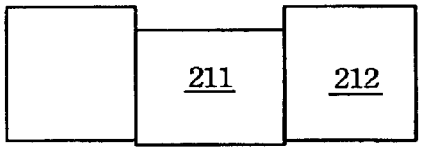
FIGS. 4A–4F illustrate six variations of impellers according to the present invention.
Figure 4D:
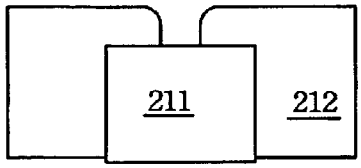
Figure 4B:
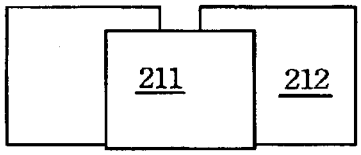
Figure 4E:
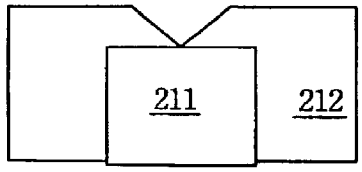
Figure 4C:
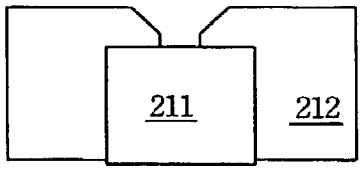
Figure 4F:
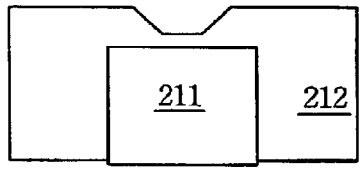

FIGS. 3A~3D respectively illustrate a top view, front view, side view and perspective view of the impeller shown in FIG. 2A or 2B. Certainly, the impeller of the present invention is not limited to that shown in FIG. 2A or 2B, the design of the impeller can be modified according to the real application FIGS. 4A–4F illustrate six variations of the impeller according to the aspect of this invention. The rotor blades 212 in FIG. 4A is only mounted on the side surface of the hub 211, but the upper edge of the rotor blade 212 is higher than the top surface of the hub 211. In FIG. 4B, the upper edge of the rotor blade 212 extends higher than the top surface of the hub 211 and to the top surface of the hub 211. The rotor blade in FIG. 4C is similar to that of FIG. 4B but has a beveled edge. The rotor blade in FIG. 4D is similar to that of FIG. 4B but has a rounded corner on the edge. The edge of the blade structure in FIG. 4E reaches the center of the hub 211. Finally, the inner edge of the rotor blade in FIG. 4F connects to a blade corresponding thereto on the top surface of the hub 211. Any edge pattern of the rotor blade that extends axially beyond the top surface of the hub in the air inlet end and potentially extending to the top surface of the hub is considered to be within the scope of the present invention. Preferably, the upper edge of the rotor blade of impeller is 3 mm higher than the top surface of the hub or extended out from the top surface of the hub to at least 5% of height of the hub.

Figure 5A:
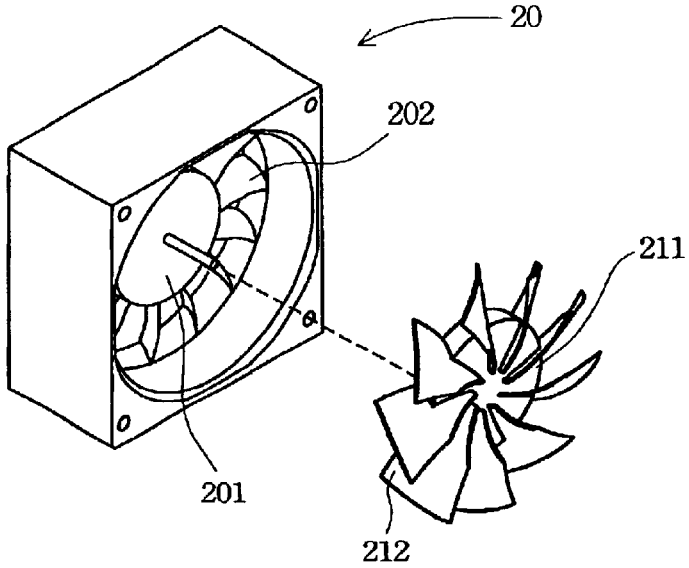
FIG. 5A illustrates a heat dissipation device with one set of air-guiding and one set of rotor blades according to one preferred embodiment of this invention.

In practice, the impeller of the present invention is employed in a heat dissipation device. The heat dissipation device has a frame 20 with a base 201 connected to the frame through a plurality of ribs for supporting the impeller thereon. In addition, the ribs can be replaced by air-guiding blades. FIG. 5 illustrates a heat dissipation device with air-guiding blades according to one preferred embodiment of this invention. The impeller 21 can be any one of the designs shown in FIGS. 4A–4F. The frame 20 includes a plurality of air-guiding blades 202 connected between the base and an outer housing The base is used to support a driving means (not shown) and the impeller 21. The plurality of air-guiding blades 202 can contribute to increase blast pressure of the heat dissipation device. Therefore, such a design can not only increase the airflow volume but also increase the blast pressure of airflow discharged from the heat dissipation device.

Figure 5B:
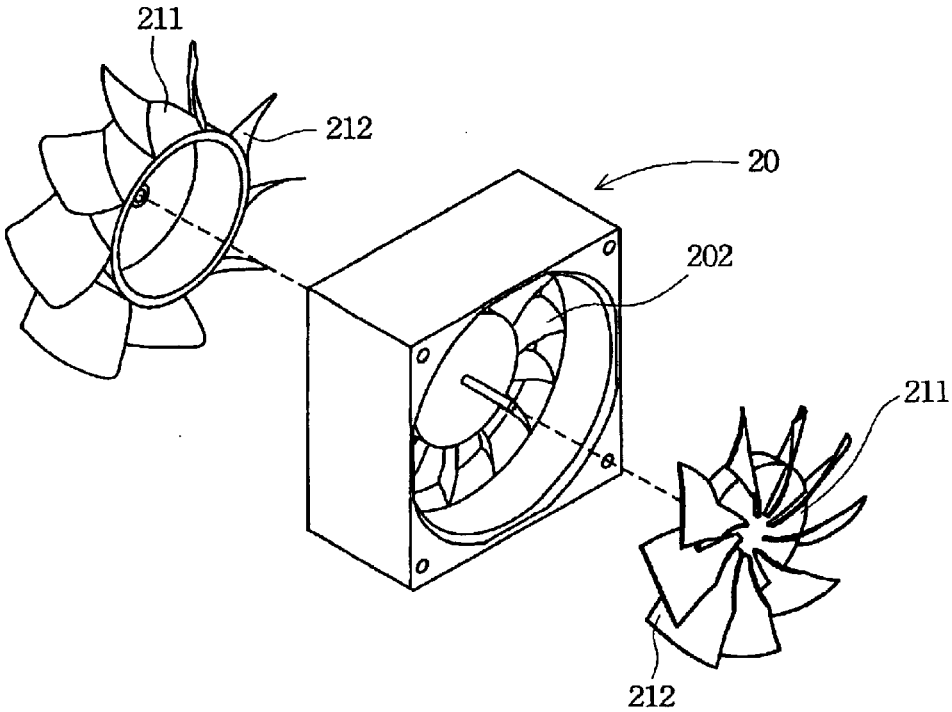
FIG. 5B illustrates a heat dissipation device with one set of air-guiding and two sets of rotor blades according to another preferred embodiment of this invention.

In addition, please refer to FIG. 5B which illustrates a heat dissipation device according to another preferred embodiment of this invention. In FIG. 5B, a set of air-guiding blades are provided in the inner center of the frame and two impellers are located in the air inlet and outlet sides of the heat dissipation device, respectively. Moreover, multiple sets of rotor blades and air-guiding blades can be arranged in different sequences to optimize performance of the heat dissipation device.

Figure 6A:
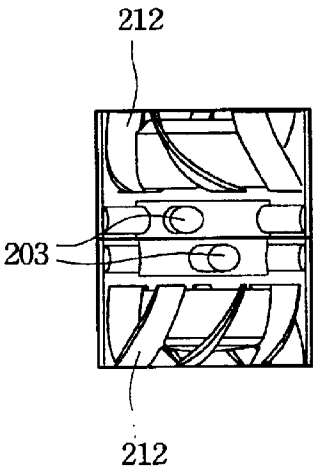
FIGS. 6A–6D respectively illustrate cross-section views of different kinds of heat dissipation devices according to this invention.
Figure 6B:
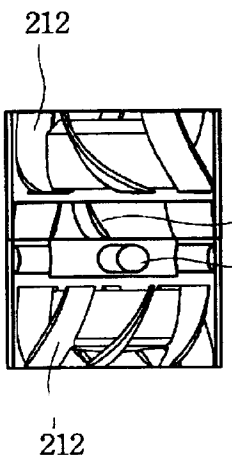
Figure 6C:
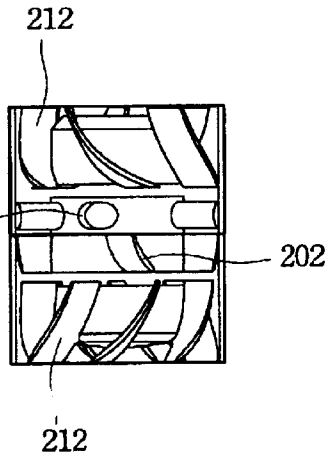
Figure 6D:
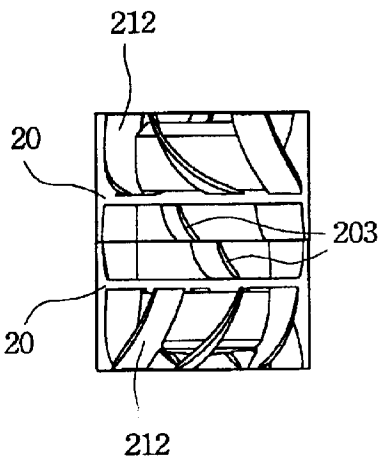

FIGS. 6A–6D respectively illustrate a cross-section view of a heat dissipation device with two frames 20, 20' and two sets of air-guiding blades or ribs according to further another preferred embodiment of this invention. FIG. 6A illustrates a heat dissipation device with two impellers 212 and two sets of ribs 203 between two impellers. FIGS. 6B–6C illustrates a heat dissipation device with two impellers, one set of air-guiding blades 202 and one set of ribs 203 arranged between two impellers. The difference between FIG. 6B and FIG. 6C is that one set of air-guiding blades 202 and one set of ribs 203 are arranged in different sequence. FIG. 6D illustrates a heat dissipation device with two frames 20, 20' respectively having one impeller and two sets of air-guiding blades 202 between two impellers 212. All dissipation devices described in FIGS. 6A–6D consist of two frames 20, 20'.

Figures 7A, 7B, 7C:
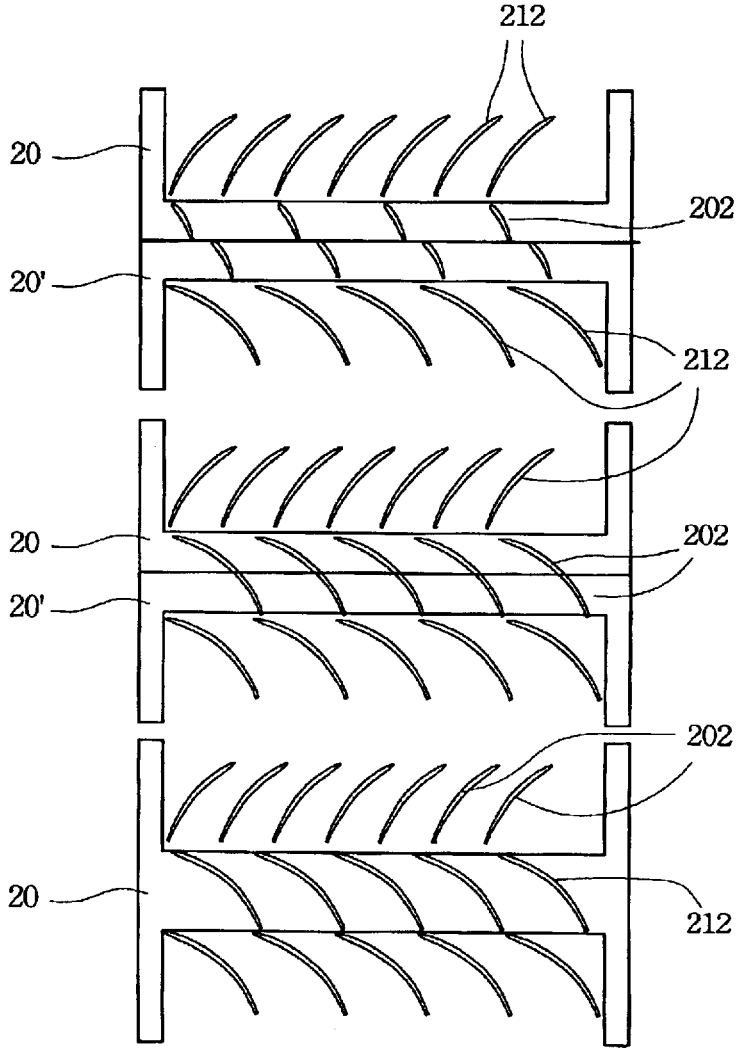
FIGS. 7A–7C illustrate different types of arrangement of air-guiding blades with respect to rotor blades according to this invention.

FIGS. 7A–7C respectively illustrate different relative arrangements of air-guiding blades and rotor blades of the impellers according to this invention. In FIGS. 7A–7B, an upper frame and a low frame are assembled to form a complete frame of a heat dissipation device. In FIG. 7A, the air-guiding blades 202 in the upper frame 20 and corresponding air-guiding blades 40 in the low frame 20' are alternatively arranged. In FIG. 7B, each of the air-guiding blades 202 in the upper frame is aligned with a corresponding air-guiding blade in low frame 20' to form a complete air-guiding blade. In other word, two corresponding half blades are joined together to form a complete air-guiding blade. In FIG. 7C, the upper frame and the low frame can be integrated into one single frame 20 while manufacturing. The air-guiding blades can also be integrated with the frame 20. It can reduce the manufacturing cost.

In view of the above description, side airflow can be introduced by the blade structure of the impeller of the present invention to increase input air volume. Additionally, one or more impellers can be used with the air-guiding blades in a heat dissipation device so as to further increase the blast pressure of the airflow discharged from the heat dissipation device due to the interaction between the rotor blades and the air-guiding blades.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An impeller comprising:

a hub; and a plurality of rotor blades arranged around said hub, wherein each inner side of said plurality of rotor blades radially extends toward a center of said hub, and inner edges of said plurality of rotor blades are higher than a top surface of said hub and open so as to allow air on the top surface of said hub to radially enter the rotor blades.

2. The impeller of claim 1, wherein inner edges of said plurality of rotor blades extending toward said center of said hub are shaped as bevel, round, or square.

3. The impeller of claim 1, wherein at least two corresponding inner edges of said plurality of rotor blades are joined together.

4. An impeller comprising:

a hub having a top surface; and a plurality of rotor blades arranged around said hub, wherein upper edges of said plurality of rotor blades extend axially beyond and open to said top surface of said hub to increase intake airflow and allow air on said top surface of said hub to be discharged in an axial direction.

5. The impeller of claim 4, wherein said plurality of rotor blades further extend to a center of said top surface of said hub.

6. The impeller of claim 5, wherein at least two corresponding inner edges of said plurality of rotor blades are joined together.

7. The impeller of claim 5, wherein inner edges of said plurality of rotor blades are shaped bevel, round, or square.

8. The impeller of claim 4, wherein said upper edges of said plurality of rotor blades are at least 3 mm higher than said top surface of said hub.

9. The impeller of claim 4, wherein said upper edges of said plurality of rotor blades extend out from said top surface of said hub to at least 5% of the height of said hub.

10. An impeller comprising:

a hub having a surface; and a plurality of impellers coupled to said hub, wherein there is a space defined between open inner edges of said plurality of rotor blades and said surface of said hub for increasing intake airflow and allowing air on said top surface of said hub to radially enter the impellers.

11. A heat dissipation device comprising:

a frame; and at least one impeller installed in said frame, said impeller comprising a hub and a plurality of rotor blades arranged around said hub, wherein upper edges of said plurality of rotor blades extend axially beyond and open to said top surface of said hub to increase intake airflow and allow air on said top surface of said hub to be discharged in an axial direction.

12. The heat dissipation device of claim 11, wherein said frame further comprises a base and an outer housing wherein the base is connected to the outer housing through a plurality of ribs.

13. The heat dissipation device of claim 12, wherein said plurality of ribs are integrated into said outer housing as a single piece.

14. The heat dissipation device of claim 11, wherein said frame further comprises a base and an outer housing wherein the base is connected to the outer housing through a plurality of air-guiding blades for supporting the impeller thereon.

15. The heat dissipation device of claim 14, wherein said plurality of air-guiding blades are integrated into said outer housing as a single piece.

16. The heat dissipation device of claim 11, wherein said plurality of rotor blades radially extends toward a center position of said top surface of said hub.

17. The heat dissipation device of claim 14, wherein inner edges of said plurality of rotor blades are shaped as bevel, round or square.

18. The heat dissipation device of claim 11, wherein said at least one impeller can be disposed in an air inlet side of said heat dissipation device.

19. The heat dissipation device of claim 11, wherein said at least one impeller can be disposed in air inlet side and air outlet side of said heat dissipation device, respectively.

20. The heat dissipation device of claim 11, wherein said upper edges of said plurality of rotor blades are at least 3 mm higher than said top surface of said hub.

21. The heat dissipation device of claim 11, wherein said upper edges of said plurality of rotor blades extend out from said top surface of said hub to at least 5% of the height of said hub.

22. A heat dissipation device comprising:

two frames;

two sets of connecting parts, respectively installed in said frames; and at least one impeller installed in said frames, said impeller comprising a hub and a plurality of rotor blades arranged around said hub, wherein inner edges of said plurality of rotor blades extend axially beyond and open to said top surface of said hub in an air inlet side to allow air on said top surface of said hub to be discharged in an axial direction.

23. The heat dissipation device of claim 22, wherein said two sets of connection parts are air-guiding blades.

24. The heat dissipation device of claim 23, wherein one set of air-guiding blades are aligned with the other set of corresponding air-guiding blades and joined together.

25. The heat dissipation device of claim 23, wherein two sets of air-guiding blades are alternatively arranged.

26. The heat dissipation device of claim 23, wherein said air-guiding blades are integrated into said frames as a single piece.

27. The heat dissipation device of claim 22, wherein said two sets of connection parts are one selected from a group consisting of ribs and air-guiding blades.

* * * * *